United States Patent [19]

Hovis, Jr. et al.

[11] 4,332,617

[45] Jun. 1, 1982

[54] METHOD OF FABRICATING THIN-WALLED ARTICLES OF TUNGSTEN-NICKEL-IRON ALLOY

[75] Inventors: Victor M. Hovis, Jr., Kingston; Walter G. Northcutt, Jr., Oak Ridge, both of Tenn.

[73] Assignee: The United States of America as represented by the United States Department of Energy, Washington, D.C.

[21] Appl. No.: 76,528

[22] Filed: Sep. 18, 1979

[51] Int. Cl.[3] ..... B22F 5/00

[52] U.S. Cl. ..... 75/214; 427/34

[58] Field of Search ..... 75/200, 214; 427/34

[56] References Cited

U.S. PATENT DOCUMENTS

| | | | |
|---|---|---|---|
| 2,864,137 | 12/1958 | Brennan | 427/191 |
| 3,053,610 | 9/1962 | Shichman | 427/427 |
| 3,112,539 | 12/1963 | Barker | 427/34 |
| 3,490,116 | 1/1970 | Cape | 427/34 |
| 3,791,851 | 2/1974 | Taylor et al. | 75/200 |
| 4,011,076 | 3/1977 | Hovis, Jr. et al. | 75/200 |

*Primary Examiner*—Brooks H. Hunt

*Attorney, Agent, or Firm*—Earl L. Larcher; Stephen D. Hamel; James E. Denny

[57] ABSTRACT

The present invention relates to a method for fabricating thin-walled high-density structures oftungsten-nickel-iron alloys. A powdered blend of the selected alloy constituents is plasma sprayed onto a mandrel having the desired article configuration. The sprayed deposit is removed from the mandrel and subjected to liquid phase sintering to provide the alloyed structure. The formation of the thin-walled structure by plasma spraying significantly reduces shrinkage, and cracking while increasing physical properties of the structure over that obtainable by employing previously known powder metallurgical procedures.

2 Claims, No Drawings

METHOD OF FABRICATING THIN-WALLED ARTICLES OF TUNGSTEN-NICKEL-IRON ALLOY

The present invention is the result of a contract with the United States Department of Energy.

BACKGROUND OF THE INVENTION

The present invention relates generally to the fabrication of thin-walled articles of tungsten-nickel-iron alloy and more particularly to a method of fabricating such articles wherein the articles are of near theoretical density and possess essentially uniform properties.

Tungsten has proven to be a particularly useful material for various industrial applications and in the construction of nuclear reactors. The tungsten metal can be placed in a somewhat ductile form without seriously detracting from the desirable properties by alloying it with nickel and iron. An alloy composition found to be particularly useful is formed of essentially 95 weight percent tungsten, 3.5 weight percent nickel and 1.5 weight percent iron. However, alloy compositions with a nickel concentration in a range of about 2.1 to 7.0 weight percent and an iron concentration in a range of about 0.9 to 3.0 weight percent iron have proven to be useful in essentially the same areas as the 3.5 weight percent nickel and 1.5 weight percent iron compositions. Structures of the ductile tungsten-nickel-iron alloys are generally prepared by employing conventional powder metallurgical procedures. These procedures usually comprise the blending desired weight percents of elemental tungsten, nickel, and iron alloy powders, pressing the blended powders into a compact of the desired configuration and thereafter sintering the compact at a sufficiently high temperature to convert the minor phase of the alloy into a liquid to provide structural integrity to the sintered structure. Final densification, microstructure and properties of the structure are dependent upon the pressing and liquid phase sintering operation.

While tungsten-nickel-iron alloy structures of various configurations have been successfully fabricated by cold pressing and sintering the resulting compact, there have been some difficulties associated with the fabrication of structures having relatively thin walls, such as open cylinders and the like, because of the required liquid phase sintering operation. More specifically, the pressed compacts shrink approximately 40 volume percent during the liquid phase sintering step so that the thin-walled articles are usually subjected to extensive distortion and stresses which lead to deleterious cracking and other stress associated problems. Some techniques have been employed to overcome the distortion and cracking problems such as the use of multiple sintering steps and special sintering mandrels. However, even with such techniques, uniform, physical and mechanical properties are seldom achieved. For example, the density and tensile strength of the sintered structure usually vary by greater than 1 percent and 4 percent, respectively, over the structure.

SUMMARY OF THE INVENTION

Accordingly, it is a primary objective or aim of the present invention to provide a method for fabricating thin-walled articles of tungsten-nickel-iron alloy which are particularly characterized by uniform properties and which can be fabricated to virtually the finished article dimensions without utilizing special sintering procedures and mandrels. Additionally, the method of the present invention will provide a thin-walled tungsten-nickel-iron alloy article which is characterized by a uniform density variation of less than 0.5% and a variation in tensile strength of less than 4%. The objective of the present invention is achieved by a fabrication method which comprises the steps of blending together particulates of tungsten, nickel and iron in quantities sufficient to provide the desired alloy composition, injecting the blended powder composition into a plasma stream for spraying the alloy constituents onto a mandrel to form the structure with a wall thickness in the selected range of about 0.025 to 0.500 inch, and thereafter separating the structure from the mandrel and heating the plasma-sprayed structure to a temperature sufficient to liquefy a minor phase of the alloy constituents to form the alloy.

By employing a plasma spraying procedure the blended powder composition can be sprayed onto a mandrel in a highly controllable manner to provide a compact of the desired shape and wall thickness. Another advantage gained by employing a plasma spraying operation in the present method is that the compact, as sprayed, is at a significantly higher density than achievable by employing a cold-pressing and sintering operation as previously utilized so that the as-sprayed articles shrink significantly less during the liquid phase sintering step. Further, the problems associated with distortion and stresses are substantially reduced or minimized by the fact that less shrinkage occurs during the sintering operation.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

As briefly described above, the present invention relates to a method for preparing thin-walled articles of tungsten-nickel-iron alloy. The articles so prepared are characterized by a uniform material density having a variance of less than 0.5%, a small pore porosity distribution of less than 1 volume percent, and a uniform tensile strength having a variance of less than 4%. Also these articles are characterized by exhibiting considerable less cracking and stress problems than thin-walled articles prepared by previously utilized powder metallurgical procedures.

The method of fabricating the articles in accordance with the present invention is achieved by mixing measured portions of the alloy constituents into a homogeneous blend. The alloy constituents comprise tungsten powder of a particle size in a range of about 5 to 30 $\mu$m in a quantity adequate to provide 90 to 97 weight percent of the alloy, nickel powder of a particle size in a range of 2 to 20 $\mu$m and of a quantity adequate to provide 2.1 to 7.0 weight percent of the alloy, and iron particulates in a particle size range of about 5 to 30 $\mu$m and of a quantity adequate to provide about 0.90 to 3.0 weight percent of the alloy.

After mixing the alloy constituents into the desired blend the powders are injected into a suitable location of a plasma-spraying system or gun so that the alloy constituents may be plasma sprayed onto a mandrel to form a thin-walled composite of the desired configuration. The plasma-spraying system usable in the present invention preferably uses an argon gas composition at a flow rate of about 65–75 standard cubic feet per minute. The carrier gas used for the powder is also preferably argon flowing at a rate of about 3–5 standard cubic feet per minute. The arc current used in the plasma gun is in a range of about 350 to 420 amps with an anode to cathode voltage of about 30 to 48 volts. During the spraying operation the gun standoff distance from the mandrel of about 2.5 to 3.5 inches has proven to be satisfactory for spraying powder at a feed rate of about 7.5 to 24.0 grams per minute. The temperature to which the powder is subjected during the plasma-spraying operation is in the range of about 4000° to 6000° C. While this temperature is sufficient to vaporize iron and nickel, the dwell time of these powders in the plasma stream is inadequate to effect deleterious vaporization.

The plasma spraying of the blend of alloy constituents in the above size range was found to provide unexpected results in that it was previously felt that the use of submicron size powder would be necessary for plasma spray forming the tungsten-nickel-iron alloy but that powder of such a small size was not capable of use in plasma-spraying apparatus. It is also felt that if the temperature of the plasma stream would be sufficient to melt the tungsten, then the iron and nickel powders in the blend would vaporize prior to reaching the mandrel so as to render impractical plasma spraying of tungsten-nickel-iron powder blend. However, it was found that the dwell time of the nickel and iron powder in the plasma stream is sufficiently short so as not to effect vaporization thereof. It was also unexpected that the tungsten powders of the relatively large size as employed in the present invention could be used in plasma spraying in that the sprayed composite appeared to contain clumps or agglomerations of tungsten particulates. However, it was found that when these agglomerates or clumps of sprayed material were subjected to the liquid-phase sintering step, the powders would run together so as to provide the desired alloying effect. Further, it was found that the use of a dry or wet hydrogen atmosphere to minimize blistering problems encountered in the sintering of the tungsten-nickel-iron alloys was not required for the liquid sintering of the plasma-sprayed composite provided by the present invention. In practicing the present invention it is imperative that the alloy constituents being employed be of raw materials since previously alloyed tungsten-nickel-iron alloys will not work due to excessive ductility thereof.

After plasma spraying the blended alloy composition onto the mandrel to form the thin-wall composite with a wall thickness in the range of about 0.025 to 0.500 inch, the composite is cooled and removed from the mandrel by simply cooling the mandrel while slightly heating the composite. The composite is then placed in a suitable furnace in a dry hydrogen atmosphere or any other suitable atmosphere and heated at a rate of about 40° to 400° C. per hour to a temperature in the range of about 1460° to 1600° C. for a duration of about 30 to 120 minutes for effecting the liquid phase sintering operation. After the desired time the furnace is allowed to cool to room temperature.

In order to provide a more facile understanding of the present invention, examples relating to the fabrication of thin-walled tungsten-nickel-iron alloy articles are set forth below.

EXAMPLE 1

A substrate of a hexagonal exterior form was placed in a spraying chamber and aligned with a plasma spray gun. The spraying chamber was then closed and purged with argon at atmospheric pressure to provide an inert atmosphere for the spraying operation. The substrate was plasma sprayed with a tungsten-3.5% nickel-1.5% iron powder composition for 65 minutes to form a composite with a wall thickness of 0.15 centimeter over the entire substrate. After plasma spraying the substrate, the article was removed from the substrate by heating the sprayed layer. Specimens cut from the flat sections of the sprayed hexagonal article were examined and sintered. The specimens subjected to sintering were lowered into a resistance heated furnace and heated at a rate of 400° C. per hour to 1465° C. in a dry hydrogen atmosphere. The specimens were held at 1465° C. for 60 minutes and then furnace cooled in hydrogen to room temperature. The plasma sprayed specimens had an as-sprayed deposit composition of 95.44 weight percent tungsten, 3.56 weight percent nickel and 1.32 weight percent iron. The sintered density of the specimens was 99.5 percent of theoretical. They exhibited a sintered tensile strength of 849 Mega Pascals (MPa) to 905 MPa and an elongation of 9 to 21 percent.

EXAMPLE 2

Four cylindrical coatings of a wall thickness in the range of 0.10 to 0.13 centimeter were plasma sprayed and sintered by practicing the steps set forth in Example 1. Table 1 below lists the properties of these cylinders before and after sintering.

TABLE 1

| Specimen | Sprayed Deposit Porosity (Vol. %) | Sprayed Deposit Composition (wt. %) W | Ni | Fe | Sintered Density (% of theoretical) |
|---|---|---|---|---|---|
| Cylinder #2 | 16.05 | 95.83 | 2.83 | 1.19 | 99.4 |
| Cylinder #3 | 16.53 | 91.33 | 6.38 | 2.33 | 99.8 |
| Cylinder #4 | 16.06 | 93.14 | 4.93 | 1.95 | 99.4 |
| Cylinder #9 | 13.50 | 96.2 | 2.48 | 1.09 | 99.2 |

EXAMPLE 3

Tensile specimens were prepared from the powder compositions and by practicing the steps set forth in Example 1, two lots of six tensile specimens each were simultaneously sprayed onto a hexagonal mandrel arrangement to give six flat specimens 2.54 centimeters wide by 7.6 centimeters long and a thickness of 0.13 centimeter. The properties of these specimens before and after sintering are set forth in Table 2 below.

TABLE 2

| Tensile Specimen | Sprayed Deposit Porosity (Vol. %) | Sprayed Deposit Composition (wt. %) W | Ni | Fe | Sintered Density (% of theoretical) |
|---|---|---|---|---|---|
| Lot #1 | 18.2 | 95.44 | 3.56 | 1.32 | 99.4 |
| Lot #2 | 14.9 | 95.00 | 3.46 | 1.32 | 99.1 |

It will be seen that by practicing the method of the present invention that thin-walled articles of tungsten-nickel-iron alloys may be readily prepared in a more facile manner than previously attainable. The reduced shrinkage of the article during sintering also eliminates a significant problem previously encountered. Further, the higher green strength of the as-sprayed composites facilitates handling of the composites during the fabrication process. Also, by using the plasma-spraying step of the present invention a considerable savings in raw material is realized and significantly less machining is required on the finished or sintered product.

What is claimed is:

1. A method of fabricating an article of tungsten-nickel-iron alloy formed of 90 to 97 wt.% tungsten, 7 to 2.1 wt.% iron, and 3 to 0.09 wt.% nickel with said article being characterized by a wall thickness in the range of 0.025 to 0.500 inch, a density of greater than 99 percent theoretical, a variance in density over the article of less than about 0.5% and a variance in tensile strength over the article of less than about 4.0%, said method consisting essentially of the steps of blending together constituents of said alloy consisting of discrete particulates of tungsten, nickel and iron in quantities sufficient to provide said alloy, injecting a sufficient quantity of the blended particulates into a plasma stream for spraying the alloy constituents onto a mandrel to form a structure of the alloy constituents with a wall thickness substantially in said range, separating the structure from the mandrel, and thereafter heating the plasma-sprayed structure to a temperature sufficient to liquefy a minor phase of the alloy constituents for forming said alloy by liquid-phase sintering.

2. A method of fabricating an article of tungsten-nickel-iron alloy as claimed in claim 1, wherein said plasma stream is at a temperature in the range of about 4000° to 6000° C., wherein the dwell time of the particulates in the plasma stream is maintained for a duration insufficient to effect the vaporization of the nickel and iron particulates, and wherein the tungsten is of a particle size in the range of 5 to 30 μm, the nickel is of a particle size in the range of 2 to 20 μm, and wherein the iron is of a particle size in the range of 5 to 30 μm.

* * * * *